United States Patent [19]

Bielecki et al.

[11] 4,176,624

[45] Dec. 4, 1979

[54] DIESEL ENGINE WITH ELECTRONIC CONTROL

[75] Inventors: Marek Bielecki, Poznán; Andrzej Bogdański, Warsaw; Andrzej Buxakowski, Poznán; Janusz Chudziński, Poznán; Andrzej Głogowski, Poznán; Marian Kopczyński, Poznán; Andrzej Królikowski, Poznán; Józef Kryszewski, Poznán; Zdzisław Moczulski, Warsaw; Włodzimierz Ochocki, Poznán; Aleksander Pomorski, Warsaw; Karol Rumatowski; Janusz Sawicki, both of Poznán; Henryk Szostakowski; Tadeusz Warowny, both of Warsaw; Teofil Wiśniewski; Antoni Woźniak, both of Poznán, all of Poland

[73] Assignees: Politechnika Poznanska; Zaklady Przemyslu Metalowego, both of Poznan, Poland

[21] Appl. No.: 760,670

[22] Filed: Jan. 19, 1977

[30] Foreign Application Priority Data

Jan. 27, 1976 [PL] Poland ..... 186837

[51] Int. Cl.[2] ..... F02B 3/00

[52] U.S. Cl. ..... 123/32 EA

[58] Field of Search ..... 123/32 EA, 32 EB, 90.11

[56] References Cited

U.S. PATENT DOCUMENTS 3,682,152 8/1972 Mullerberner ..... 123/32 EA 3,914,580 10/1975 Watson et al. ..... 123/32 EB

FOREIGN PATENT DOCUMENTS 1395027 5/1975 United Kingdom ..... 123/90.11

*Primary Examiner*—Charles T. Jordan

*Attorney, Agent, or Firm*—Haseltine, Lake & Waters

[57] ABSTRACT

A multi-cylinder, two- or four-stroke Diesel engine with electronic control, comprising piston-and-crank assembly, electropneumatically or electrohydraulically controlled inlet and exhaust valves, and injectors supplied with fuel under a high pressure, provided with control depending on at least one operational parameter of the engine, characterized in that with the main shaft a digital transducer of the angular velocity (5) is coupled, the transducer being further connected with the first input of the computer (6), over a shaping element (7). To the second input of the computer (6) an assembly of analog-to-digital converters (8) is connected, and to the assembly the sensors (9) of the operational parameters of the engine and of the charge exchange are connected. The first output of the computer is connected to an electronic actuator (10) which further transmits, to individual injectors, a current pulse having a duration corresponding to the operating time of the injector electromagnet, whereas the second output of the computer (6) is connected to an electronic actuator (11) which further transmits, to individual inlet valves, pulses controlling the actuators for opening and closing of the valves. The third output of the computer (6) is connected to an electronic actuator (12) which further transmits, to individual exhaust valves, pulses controlling the actuators for opening and closing the valves, and the fourth output of the computer (6) is connected to an electronic actuator (13) which acts on the power receiver of the engine to change its load in accordance with the optimum setting of the fuel charge for the given rotational speed of the engine.

10 Claims, 6 Drawing Figures

DIESEL ENGINE WITH ELECTRONIC CONTROL

FIELD OF THE INVENTION

This invention relates to a multi-cylinder, four- or two-stroke Diesel engine with electronic control.

DESCRIPTION OF THE PRIOR ART

There are known Diesel engines controlled mechanically wherein the distribution shaft, being itself driven by the main shaft of the engine, drives, usually through cam followers, push rods and valve rockers, the inlet valves, the exhaust valves and at the same time the fuel injection pump assembly, providing for an adequate amount of fuel to be injected. Timing of valves, expressed in degrees of angle of rotation of the crankshaft for a given type of engine, is determined and invariable.

There are also known fuel injection units providing for a fuel injection in accordance with predetermined angles of rotation of the crankshaft, and containing one monostable multivibrator determining the duration of the injection. Pulses generated by such a multivibrator, on being amplified, are supplied over contacts of a mechanical sequence selector of required operation in accordance with ignition sequence, to the relevant electromagnetically opened fuel injector. The operation of said sequence selector is synchronized with the distribution system or with the ignition distributor. Precise metering of the fuel amount before injection requires considerable reduction of the duration of the dead period of the operational time of the injectors, said dead period occurring due to the generation and collapse of the magnetic field. Moreover, in known injection units to reduce the response time of the injectors very short lasting opening pulses with high value of the magnetizing current are supplied thereto, followed subsequently by reduction of the current value to the value necessary to sustain the magnet of the injector.

There is also known a design of an injection unit for small power engines disclosed by the Company Sofredi in their publication "*Adaptation de l'injection électronique aux moteurs Diesel*", CIMAC, A-31, 1971, characterized by that the force developed by the magnet is assisted by a force effecting from the fuel pressure. Said assisting force being developed by a plunger is transmitted onto the injector needle through the mechanical follower. The injector magnet is connected with the power recovery system being aimed at collecting the energy required to obtain a quick response to the injector to the controlling pulse. The circuit of the power recovery system contains capacitance arrangements.

The known electrically controlled injection unit for an internal combustion engine, according to the Polish Patent Specification No. 69 027, contains at least two injectors being opened alternately at proper moments, and one common for said injectors monostable multivibrator generating opening pulses the length whereof depends on at least one of engine parameters. Said arrangement is characterized by that at least one memory system generating extending pulses following the basic pulses generated by the controlling multivibrator, the duration whereof depends on the duration of the basic pulse, is operationally connected with said control multivibrator, the duration of the extending pulses being proportional to the basic pulse duration.

Another design of a control signal distributor built of gate circuits is described in the U.S. Pat. No. 3,782,338.

A system controlling the actuation of the inlet and the exhaust valves for Diesel engines is described in the German Patent Specification No. 1.342.292, in which two series of control pulses affecting the final actuator are generated by an electronic generator.

The hitherto known designs relate only to detailed solutions of the particular assemblies of a Diesel engine, such as fuel injection control system with special emphasis on the actuators, and also inlet and outlet valve control system.

SUMMARY OF THE INVENTION

In the design according to the invention a digital converter of angular velocity is coupled with the main shaft, and further, over a shaping element, it is connected with the first input of the counter circuit. Connected to the second input of the counter circuit are the analog-to-digital conversion system, the engine operating parameter sensors and the charge exchange sensors. The first output of the counter circuit is connected with the electronic actuator, which subsequently transmits the current pulse to the particular injector, said pulse duration remaining in accordance with the duration of the control pulse, determined by the counter circuit. The second output of the counter circuit is connected with the electronic actuator which further sends, to the particular inlet valves, pulses to control the actuators opening and closing said valves. The third output of the calculator is connected with the electronic actuator transmitting further the pulses to the particular exhaust valves, controlling the actuators opening and closing said valves. The fourth output of the counter circuit is connected with the electronic actuator acting on the engine power consumer to optimize the fuel charge and the given speed of the engine.

A structural feature of the calculator is that its first input constitutes also the first input of the rotational velocity error calculating circuit, said circuit being characterized by proportional-integrating or proportional-integrating-derivating action, the input of the digital integrator circuit, the input of the control circuit emitting pulses in proper sequence and of proper duration, and finally the input processing the operating parameters of the engine. The second input of the calculator constitutes, however, the first input of processing circuit of the engine operating parameters, containing a system of logic circuits, counters, comparators, and a storage block. The first output of the rotational velocity error calculting circuit is connected to the third input of the circuit processing the engine operating parameters, and to the first input of the digital-to-analog converter, the output of which constitutes the first input of the counter circuit, whereas the second output of the rotational velocity error calculating circuit is connected to the second input of the digital integrator, the third input of comparators, the third input of the rotational velocity error calculating circuit, and the third input of the digital-to-analog converter are connected with the control circuit. The first output of the digital integrator circuit is connected with the first input of the first comparator, the second output of the digital integrator is connected with the first input of the second comparator. At the same time the first input of the third comparator receives a signal of the optimum fuel charge. The output of the first comparator is connected with the first input of the first programmable time-counter, the output of which constitutes the third output of the counter circuit, whereas the output of the second comparator constitutes the fourth output of the counter circuit. The first input of the rotational velocity error calculating circuit constitutes one input to the element AND, and the second input of the rotational velocity error calculating circuit is connected with the engine parameters processing circuit, and constitutes the first input of the programmable time-meter. The third input of the rotational velocity error calculating circuit constitutes the third input of the programmable time-meter. The second input of the programmable time-meter is connected with the digital setting-up circuit having a parallel structure, whereas the output of the element AND is connected with the fourth input of the programmable time-meter. At the same time the programmable time-meter output is connected with the one input of the OR element and with the zero state blocking device, and with the blocking device of the state defining the maximum fuel charge, whereas the output of the zero state blocking unit is connected with the second output of the AND element. The output of the blocking unit of the state defining the maximum fuel charge is connected with the second input of the OR element, the output of the said OR element being through the block connected with the adjustment circuit of the proportional-action factor, and at the same time the output of the adjustment circuit of the proportional-action factor constitutes the second output of the rotational velocity error calculating circuit. The detector and the first input of the parallel digital adder are connected with the output of the adjustment circuit of the proportional-action factor. The detector is connected to the one input of the AND element, being further connected with the first input of the digital integrator, whereas the output of said integrator is connected with the second input of the parallel digital adder and with the second input of the digital integrator circuit, as well as with the second input of the digital integrator blocking unit, whilst the second signal from the detector is supplied simultaneously to the second input of the digital integrator and to the first input of the sign of digital integrator circuit, and to the first input of the digital integrator blocking unit.

The signal from the output of the sign circuit of the digital integrator is transmitted to the third input of the parallel digital adder, whereas the output of the parallel digital adder is connected with the block, the output of which constitutes the first output of the rotational velocity error calculating circuit. The first input of the digital-to-analog converter constitutes the input of the binary counter which is connected via the decoder with the first input of the bistable multivibrator, whereas the second input of the digital-to-analog converter is connected with the third output of the engine parameter processing circuit, when the third input of the digital-to-analog converter constitutes the one input of the AND element, said AND element output being connected to the second input of the binary counter. The signal from the output of the bistable multivibrator is supplied to the second input of the AND element, said input constituting also the output of the digital-to-analog converter.

The electronic actuating system for controlling the injectors contains a main feeder connected via a switching transistor and the in-line forcing condenser with the coil of the electromagnet, parallel to which a diode is connected, having a resistor connected in series. An auxiliary feeder with smaller power is connected in series with the main feeder in such way that its negative pole is in short-circuited with the positive pole of the main feeder, whereas its positive pole is connected via a resistor with a quench condenser, and via another resistor with the forcing condenser.

According to the invention, the engine is provided with the injector in the lower part of which a piston is mounted slidably in a cylindrical chamber, whereas with the lower end of said piston a needle is contactwise connected, over the opposite tapered end of said needle, which together with the piston forms a differential assembly. The largest diameter of the piston is larger than that of the needle. The control slide of the injector is formed in such way that its offsets form at least two peripheral channels, and the cylinder of the slide is provided with at least one peripheral channel situated against the offsets of the slide so that at least one of the peripheral channels thereof connects hydraulically the chamber of the piston with the supply pipe. In the upper position of the slide, one of its peripheral channels together with the peripheral channel of the cylinder connects the chamber with the drain pipe. Behind the slide there is arranged the outlet pipe with an overflow valve, and with at least one gland.

The invention enables the automatic adjustment of the optimum associations of the operating parameters of the internal combustion engine, as fuel charge, course of injection, amount of air supplied, variation of the load through a very simple method of synchronization of the output signals with the rotation of the main shaft, as well as the adjustment of injection advance angles, angles of valve openings, and starting the operation of separate engine cylinders. It follows here also a notable sparing of energy lost in actuating members of the engine, and reduction of operational noise of the engine through obtaining a milder run of the combustion pressure curve over the entire range of the engine power, and at last a reduction of the toxicity of exhaust gases with reduced consumption of fuel. The invention simplifies significantly the construction of the engine as it relates to the labor and material consumption, for instance, through elimination of the mechanical controller, the injection pump and the timing gear system. The signals necessary for determining the parameters of the engine operation parameters are generated by an electronic digital control unit as functions of variables resulting from the actual conditions of the engine, the type of load, and from the set values of controlled quantities. The signals from the control unit are subjected to conversion into analog form, to amplification, and to transformation in a mechanical form by suitable converters and actuators of electrohydraulic and electropneumatic type. The system can comprise any number of cylinders working in any geometric configuration.

The electronic control makes it possible to obtain a static characteristic of the path of digital proportional-action system of computing the velocity error with saturation from the bottom for the zero state, and from the top for the maximum state. The principle of synchronized operation of the control system involves the synchronization of calculating the velocity error in the programmable time-meter, and is characterized in that at the moment of starting the calculation of the velocity error in the time-meter takes place at the moments corresponding with determined positions of the engine shaft, the impulse corresponding with said positions being supplied to the input of the bistable multivibrator, whereas to the second input of which the impulses from the control system are supplied, having the frequency corresponding with the counting time of the digital system. The solution of the decoder makes it possible to decode the fixed sign number, registered in the time-meter into a number with two possible signs, plus or minus, one of the decoder outputs being the sign output. The construction of the controller enables one to obtain both positive and negative rotational velocity errors in the time-counter in the form of a number having fixed sign. The operation of setting the moment of starting the injection consists in the suppressing of single pulses coming from the transducer of the angle of rotation of the shaft, counting from the reference pulse, the value of the angle of advance being quantized to the value of 360°/c, wherein c is the number of pulses corresponding with one revolution of the transducer.

The operation of the system controlling the valves consists therein that the pulse starting the motion of both inlet and outlet valves, with electropneumatic or electrohydraulic drive, is worked out through suppression of pulses coming from the shaft rotation angle transducer, and it admits to speed up or to delay the opening angle of inlet valves by an angle corresponding to 360°/c, wherein c is the number of pulses corresponding to one revolution of the transducer, or it involves the multiple of said value in dependence on various conditions of the operation of the engine. It also makes it possible to extend or to shorten the opening time of both inlet and exhaust valves by the value of the angle 360°/c or multiple of that value in dependence on various operational conditions of the engine.

The electronically controlled fuel injector permits a variable injected fuel charge to be obtained from a zero-approaching value to the maximum charge in dependence on the load of the Diesel engine, with possibility of obtaining in the initial phase of the injection a rapid or stepwise increasing intensity of the fuel flow.

BRIEF DESCRIPTION OF THE DRAWING

An exemplary embodiment of the invention is shown in the drawing, in which.

DETAILED DESCRIPTION

Figure 1:
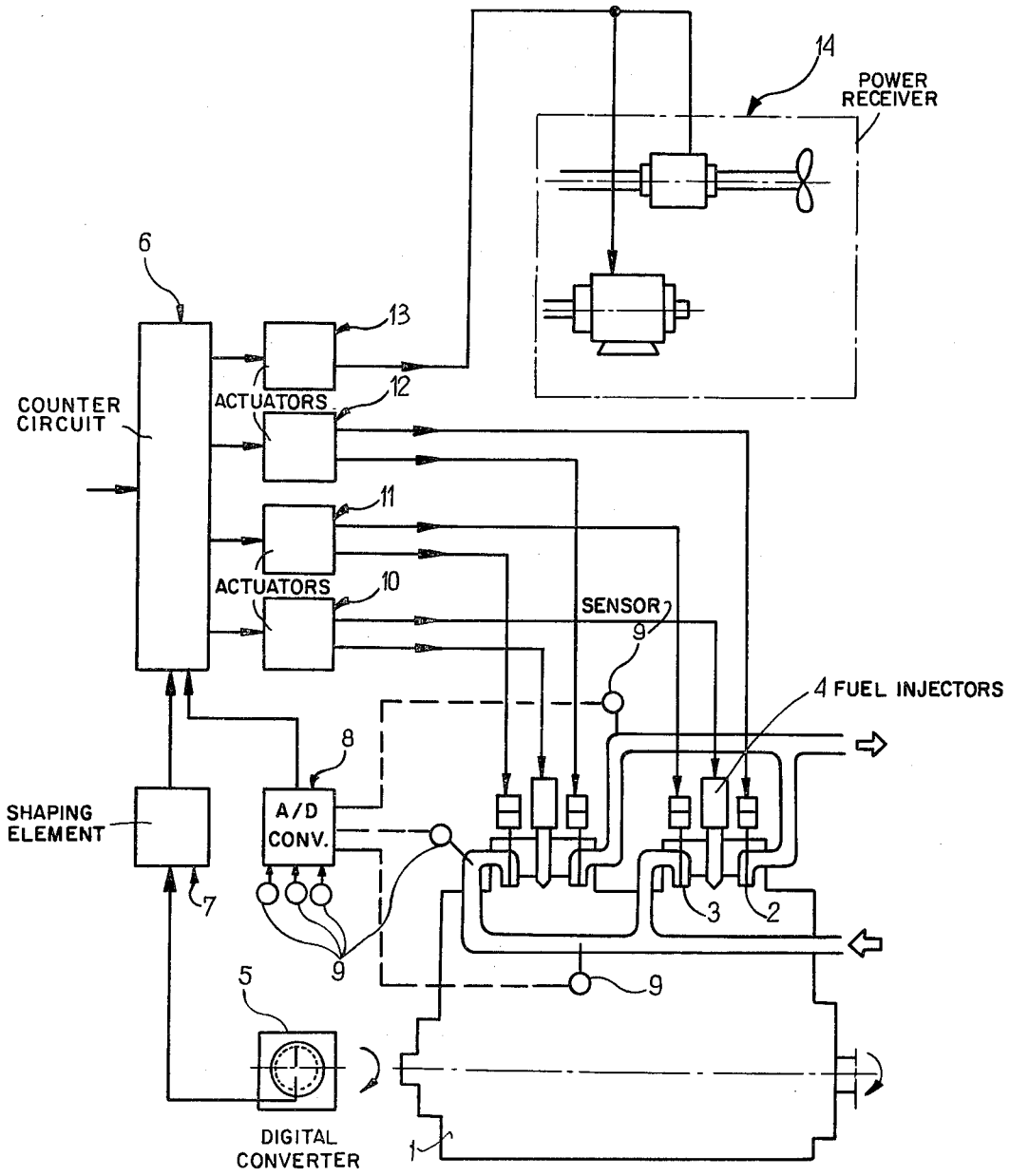
FIG. 1 is a pictorial diagram of the engine control system.
Figure 2:
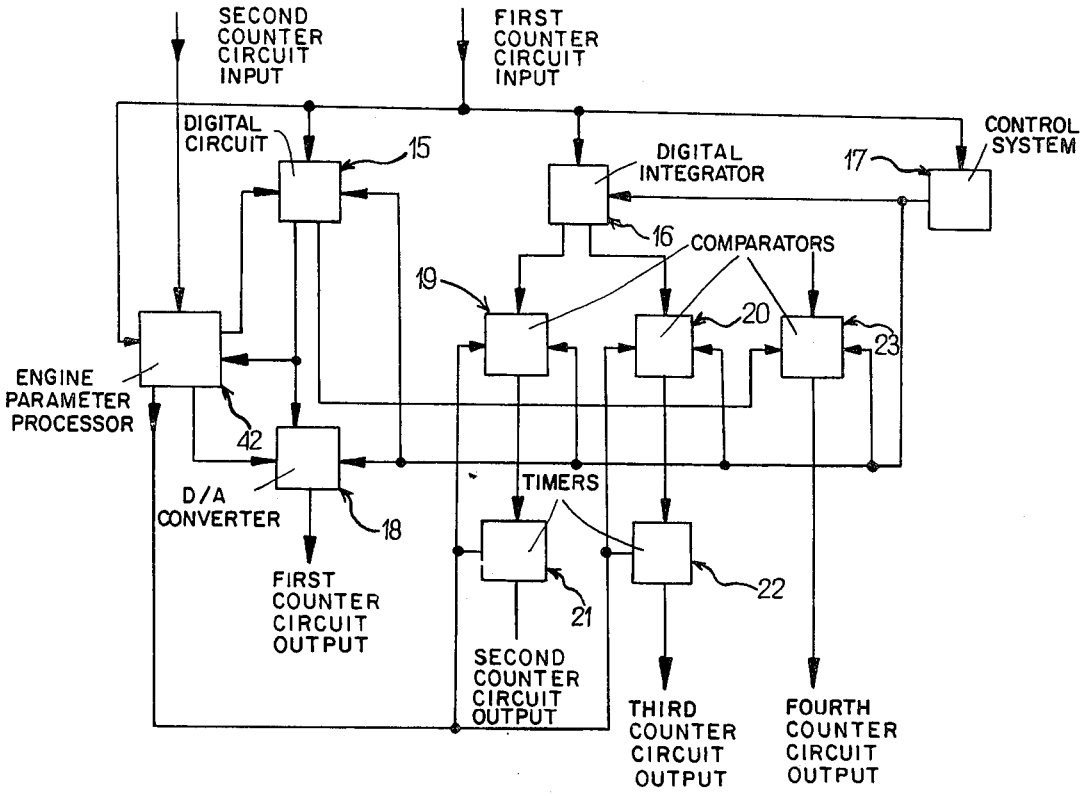
FIG. 2 is a schematic diagram of the computer.
Figure 3:
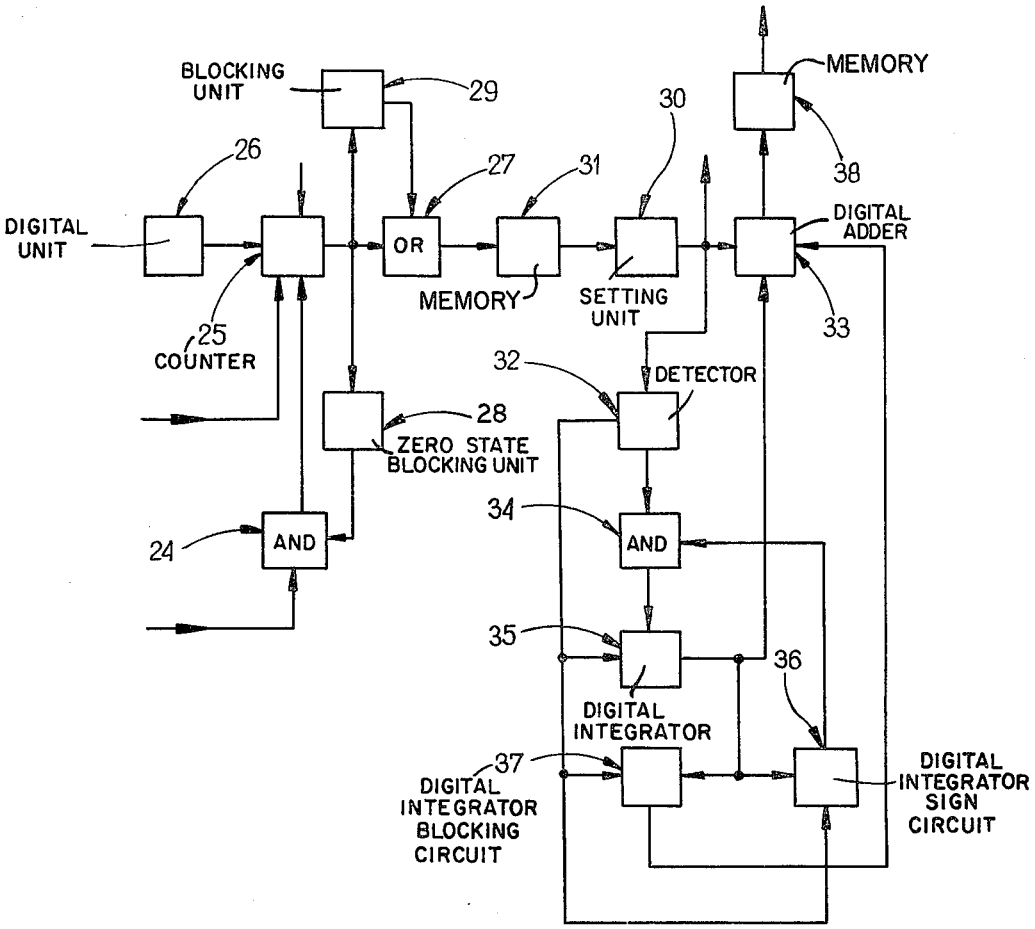
FIG. 3 is a schematic diagram of the rotational velocity error calculating circuit.
Figure 4:
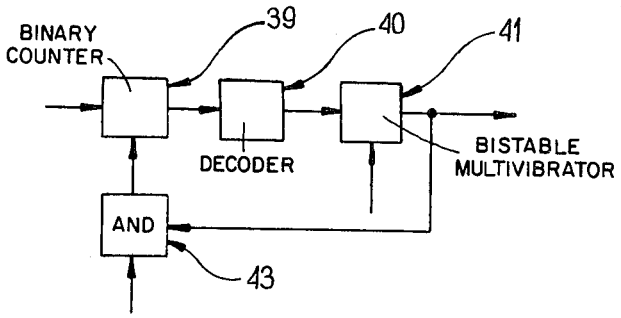
FIG. 4 is a schematic diagram of the digital-to-analog converter.
Figure 5:
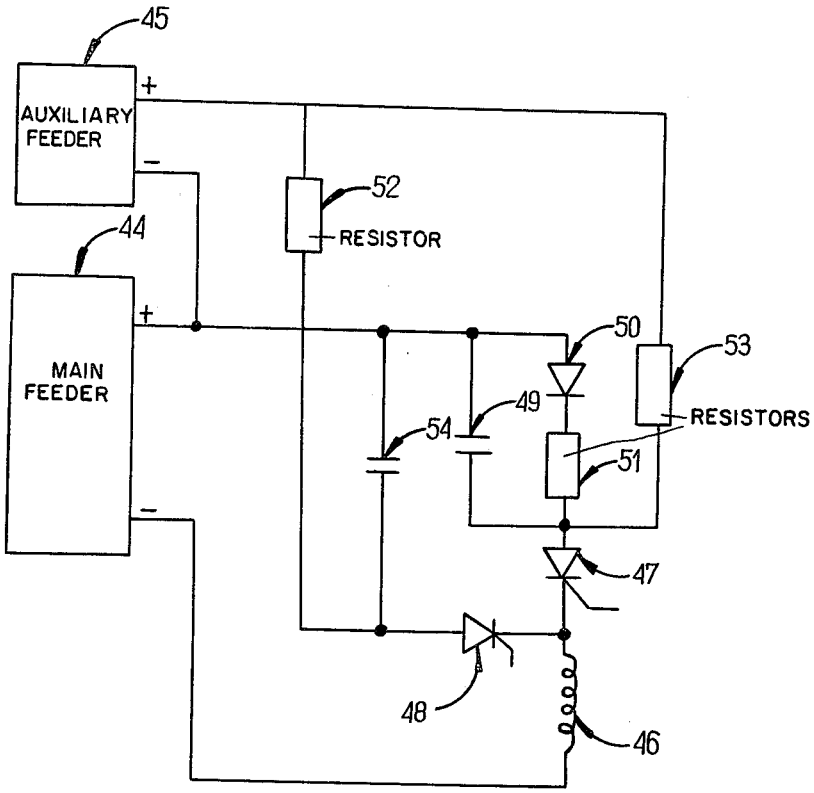
FIG. 5 is a schematic diagram of the electronic actuator.
Figure 6:
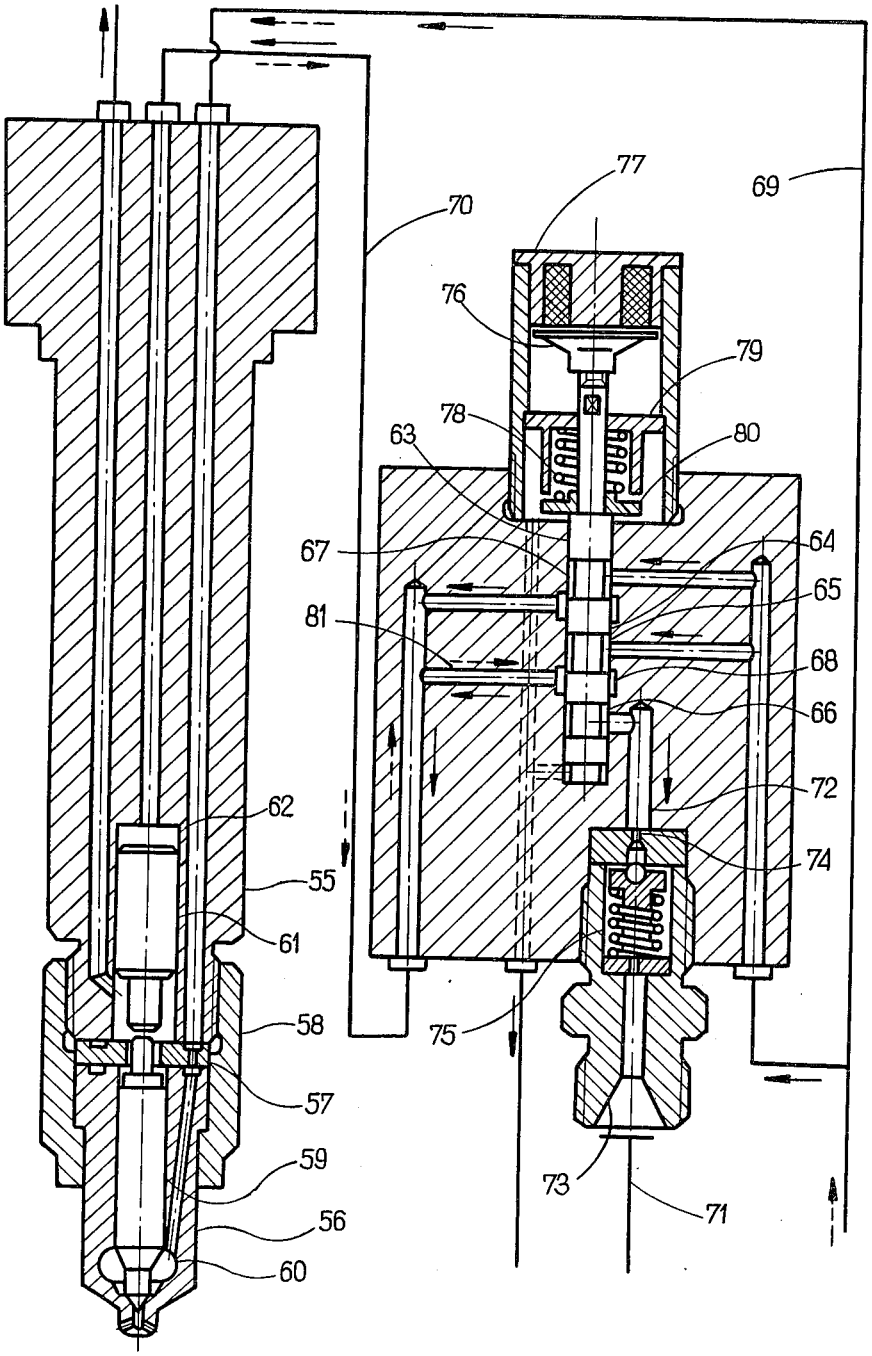
FIG. 6 is a sectional view of the injector.

The engine according to the invention is composed of the piston-and-crank assembly 1, the inlet valves 3 and exhaust valves 2, controlled electropneumatically or electrohydraulically, and injectors 4 supplied with fuel under a high pressure. Coupled to the main shaft is a digital converter 5 of angular velocity and the converter 5 is coupled, via shaping element 7 with the first input of a counter circuit 6. To the second input of the counter circuit 6 an arrangement of analog-to-digital converters 8 is connected, whereto the sensors 9 of the engine operating parameters and of load variation are connected. The first output of the counter circuit 6 is connected with the electronic actuator 10, which transmits further, to individual injectors 4, the current pulse with duration corresponding to the operation time of the injector magnet. The second output of the counter circuit 6 is connected with the electronic actuator 11, which transmits further, to individual inlet valves 3, the pulses controlling the actuators for opening and closing of said valves. The third output of the counter circuit 6 is connected with the electronic actuator 12, which transmits further, to individual exhaust valves 2, the pulses controlling the actuators for opening and closing of said valves. The fourth output of the counter circuit 6 is connected with the electronic actuator 13, which acts upon the power receiver 14 of the engine to change the load thereof in accordance with the optimum fuel charge for the given rotational speed of the engine.

The construction of the counter circuit 6 as follows:

With the first input of the counter circuit 6 there are connected:

the first input of the digital circuit 15 for calculating the rotational speed error, with proportional-integrating or proportional-integrating-derivating action, the input of the digital integrator circuit 16, the input of the control system 17 emitting pulses in proper sequence and with adequate duration, and the second input of engine parameter processing circuit 42. The second input of the counter circuit 6 is connected with the first input of the engine parameter processing circuit 42. The third input of the engine parameter processing circuit 42 is connected with the first output of the rotational velocity error calculating circuit 15, and simultaneously with the first input of the digital-to-analog converter 18, and its output constitutes the first output of the counter circuit 6.

The first output of the engine parameter processing circuit 42 is connected with the second inputs of the comparators 19 and 20 and with second inputs of the programmable time-meters 21 and 22. The second output of the engine parameter processing circuit 42 is connected with the second input of the rotational velocity error calculating circuit 15.

The second output of the rotational velocity error calculating circuit 15 is connected with the second input of the comparator 23. With the control system 17 there are connected:

the second input of the digital integrator circuit 16, the third inputs of comparators 19, 20 and 23, and the third input of the rotational velocity error calculating circuit 15, and the third input of the digital-to-analog converter 18. The first output of the digital integrator 16 is however connected with the first input of the comparator 19, and the second output of the digital integrator 16 is connected with the first input of the comparator 20. To the first input of the comparator 23 the signal of the optimum fuel charge is supplied. The output of the comparator 19 is connected with the first input of the programmable time-meter 21 the output whereof constitutes the second output of the counter circuit 6. The output of the comparator 20 is connected with the first input of the programmable time-meter 22 the output whereof constitutes the third output of the counter circuit 6, the output of the comparator 23 constituting the fourth output of the counter circuit 6.

The construction of the rotational velocity error calculating circuit 15 is as follows:

The first input of said circuit 15 constitutes one input of the AND element 24. The second input of said circuit 15 constitutes the first input of the programmable counter 25. The third input of said circuit 15 constitutes the third input of the programmable counter 25, the second input of the programmable counter 25 being connected with the digital setting-up unit 26 having a parallel structure, whereas the output of the AND element 24 is connected with the fourth input of the programmable counter 25. Simultaneously the output of the programmable counter 25 is connected with one input of the OR element 27, and with the zero-state blocking unit 28, and with the blocking unit 29 determining the maximum fuel charge, whereby the output of the zero-state blocking unit 28 is connected with the second input of the AND element 24, whereas the output of the blocking unit 29 is connected with the second input of the OR element 27. The output of the OR element 27 is connected with the setting unit 30 of the proportional-action factor over the block 31. Simultaneously the output of the setting unit 30 of the proportional-action factor constitutes the second output of the rotational speed error calculating circuit 15. With the output of the setting unit 30 of the proportional-action factor there are connected:

the detector 32 and the first input of the parallel digital adder 33, said detector 32 being connected with one input of the AND element 34 which is further connected with the first input of the digital integrator 35, the output of said integrator 35 being connected with the second input of the parallel digital adder 33, and with the second input of the digital integrator sign circuit 36, and with the second input of the digital integrator blocking circuit 37. The signal from the detector 32 is simultaneously supplied to the second input of the digital integrator 35, and to the first input of the digital integrator sign circuit 36, and to the first input of the digital integrator blocking circuit 37, whereas the signal from the output of the digital integrator sign circuit 36 is supplied to the third input of the parallel digital adder 33, the output of which is connected with the block 38, the output of the block 38 constituting the first output of the rotational velocity error calculating circuit.

The digital-to-analog converter 18 has the following structure:

The first input of the digital-to-analog converter 18 is connected with the first output of the rotational velocity error calculating circuit 15, and constitutes the input of the binary counter 39 which over the decoder 40 is connected with the first input of the bistable multivibrator 41. The second input of the digital-to-analog converter 18 constitutes the second input of the bistable multivibrator 41 and is connected with the third output of the engine parameter processing circuit 42. The third input of the digital-to-analog converter 18 constitutes however one input of the AND element 43, the output of the AND element 43 being connected with the second input of the binary counter 39, and the signal from the output of the bistable multivibrator 41 is supplied to the second input of the AND element 43. Said second input of the AND element 43 constitutes as well the output of the digital-to-analog converter 18.

The arrangement of the electronic actuator 10 controlling the injectors comprises the main power source or feeder 44 connected, via the switching-on thyristor 47 and the parallel shaping capacitor 49 with parallel connected diode 50 with series connected resistor 51, with the electromagnet coil 46, the auxiliary power source or feeder 45 with lower power being series connected with the main feeder 44 in such way that the negative pole thereof is short-circuited with the positive pole of the main feeder, whereas its positive pole is connected via the resistor 52 with the quench condenser 54, and via the resistor 53 with the forcing condenser 49 being loaded from the auxiliary feeder in such way that on igniting the switching-on thyristor the voltage on the forcing condenser is added to the voltage of the main feeder, causing the flow of strong current pulse through the electromagnet winding. On discharging the condenser the current flows through the diode 50 and the resistor 51 until the extinguishing of the switching-on thyristor follows due to ignition of the quench thyristor 48.

The fuel injector 4 has its body 55 connected with the atomizing nozzle body 56 by means of the annular insert 57. An element fixing both bodies is the flanged nut 58. The atomizer comprises a needle 59 the tapered end of which is located in the seat of the injection chamber 60. The end of the needle, opposite to the tapered end, is contactwise connected with the lower end of the piston 61 being axially freely slidably mounted in the cylindrical chamber 62. The piston together with the needle constitutes the differential assembly. The largest diameter of the piston exceeds the largest diameter of the needle. The piston is hydraulically connected with the control slide 63 provided with offsets 64 which in course of motion of the slide control the flow of the liquid within the supply system. Said offsets 64 form at least two peripheral channels 65 and 66. The cylinder 67 of the slide 63 show at least one channel 68. Said channel 68 is situated against the offsets 64 of the slide that in lowest position of the slide one of its peripheral channels 65 together with the peripheral channel 68 of the cylinder 67 connects hydraulically the chamber 62 of the piston 61 with the supply conduit 69 and 70. In the uppermost position of the slide one of peripheral channels 66 thereof, together with the peripheral channel of the cylinder 68 connects the chamber 62 with the discharge conduit 71. Behind the slide 63 there are provided the discharge conduit 72 and the overflow valve 73 equipped with two suppressing nozzles 74 and 75. The control slide is mechanically coupled with the armature 76 of the electromagnet 77, whereby on the part of the slide stem, constituting a connector with the armature a reciprocal spring 78 is mounted between the stop sleeve 79 and the saucer ring 80.

Mode of Operation

The output signals from the counter circuit 6 are accordingly supplied to injectors 4 of the engine and to transducers of the hydraulic or pneumatic system of opening the inlet valves 3 and the exhaust valves 2 co-operating in controlling the operation of the engine. An additional signal from the counter circuit 6 may be supplied to the power receiver 14 for shaping the load level of the engine, to be optimum for the preset rotational speed.

The essential feature of the design according to the invention consists therein that it works out signals controlling the valves and injectors within a common counter system. The counter circuit 6 consits of a digital system 15 of calculating the error of the rotational speed, with proportional-integrating or proportional-integrating-differentiating action, of digital system 42 of processing the engine parameters, of a digital-to-analog converter 18 converting the number into the pulse duration, of the control system 17, of comparators 19, 20 and 23, of the digital integrator circuit 16, and of an assembly of programmable time-meters 21 and 22. The digital circuit 15 of calculating the rotational speed error consists of the setting-up unit 26 with parallel structure, of the programmable counter 25, of the zero-state blocking unit 28 and of the blocking unit 29 of the state determining the maximum fuel charge, of OR elements 27, of setting unit 30 of the proportional-action factor, of the decoder 32 constituting a detector of negative errors, of the digital integrator 37, of the blocking unit of the digital integrator 36, of the digital integrator sign circuit 36, and of the parallel digital adder 33. Moreover the digital, rotational speed error calculating circuit 15 is provided with an assembly of gates, especially with AND elements 24 and 34, and blocks 31 and 38, as well as with a multivibrator initiating each time the cycle of operation. By means of the setting-up unit 26 the preset value of the rotational speed in digital form is set-up, which is further transmitted in parallel to the programmable counter 25 as being increased by the maximum—as to its absolute value—negative value of the error being comprised within the linear section of the characteristic curve of the rotational speed error calculating circuit 15. That causes that on subtracting the numer of pulses coming from the converter 5 in an exactly determined time from the number supplied by the setting-up unit 26, in the programmable counter 25 always a positive number remains, corresponding with the system error. Said number is still submitted to a correction in dependence on the actual output signals from the analog-to-digital converters 8, and then it is stored in the block 31 for one operational cycle of the rotational velocity error calculating circuit 15. In the storage block 38, with some delay, the number gets stored, corresponding to the sum of the system error and the integral of the error, or, additionally, the differential of the error. The operation of the digital rotational velocity error calculating circuit 15 is controlled by the control system 17 aimed at emitting pulses in proper sequence and with adequate duration. Some pulses can cover themselves in function of time. The control system 17 operates in a defined cycle, being synchronized by a selected point of the shaft position whereby the moment of supplying signals depends also on other operational parameters of the engine. The output of the circuit 15 is connected via the AND elements and the block 38 with the output of the converter 18 converting the number registered in the block 38 for the time of duration of the pulse. The output of the converter 18 controls directly the electronic actuator 10 of the fuel injection. The beginning of the injection is determined by the engine parameter processing system 42 according to the actual parameters of the engine operation.

Supplying of the control pulse from the electronic control system 10 to the electromagnet 77 of the injector 4 causes a displacement of its armature 76 together with the control slide 63 in the extreme position thereof, in which a cutting-off of the fuel inflow over the piston 61, and opening of the flowing out of the fuel compressed above the piston through the conduit 81, slide cylinder 67 and the overflow valve 73. The force resulting from the difference of diameters between the piston 61 and the needle 59 of the atomizer is then directed upwards, which causes the opening of the needle and injection of the fuel. Breaking of the pulse controlling the electromagnet 77 causes a displacement of the armature 76 and of the control slide 63 under the action of the reciprocating spring 78 in the opposite extreme position, in which the flow path of the fuel under a high pressure above the piston 61 is opened. The piston then presses the needle 59 of the atomizer against the seat, causing the breaking of the injection.

For controlling the inlet valves 2 and the exhaust valves 3 there are in the counter circuit 6 purposed: the engine parameter processing system 42, the digital integrator circuit 16, the assembly of digital comparators 19 and 20, and assemblies of programmable timemeters 21 and 22. The digital integrator circuit 16 is connected with the output of the shaping element 7, the digital comparators 19 and 20 being controlled by the digital integrator circuit 16 and the engine parameter processing system 42, over the analog-to-digit converters 8. The proper cycle of the operation of electronic actuators 11 and 12 is determined by the control system 17 together with the digital integrator circuit 16. The opening time of the inlet and the exhaust valve is calculated by the engine parameter processing system 42, and determined by the circuits of the programmable timemeters. The beginning of opening of the valves, depending also on the operational conditions of the engine is calculated by the engine parameter processing system 42, and determined by the comparators 19 and 20. The digital engine parameter processing system 42 controls together the beginning of the injection, the duration of the injection, the starting of opening the valves and the duration of opening thereof, in dependence on the actual operational parameters of the engine, except the rotational speed. The electronic actuator 10 is constituted by a thyristor-type pulse amplifier with forcing, the switching-on thyristor thereof being in series connected with the electromagnet coil 77 of the injector 4. In this arrangement the forcing condenser is first switched-on in series with the feeder, being thereby charged from a separate source. The termination of the current pulse is caused by the quench pulse. In the arrangement, a protection is provided securing the cutting-off of fuel in case of exceeding of the preset value of the injection duration regarded as permissible.

The load optimization of the internal combustion engine is realized through acting upon the power receiver 14. This function is performed by the electronic actuator 13 controlled from the output of the system 15, said output being common for the adjustment of speed and power over the comparator 23, on the first input of which the preselected optimum charge is set. This charge is automatically set as a function of the preset speed. The output of the comparator 23 is of three values, individual values of the output signal causing the increase of the load, the decrease of the load, or maintaining the load at the previous level. The average load value can be varied from one injection to the other.

What is claimed is:

1. In a multi-cylinder, two- or four-stroke diesel engine with electronic control, comprising an output shaft, a piston-crank assembly with inlet valves and exhaust valves controlled electropneumatically or electrohydraulically, and injectors supplied with fuel under high pressure provided with control means for regulating fuel supply as a function of at least one operational parameter of the engine, said control means including an electromagnet, the improvement comprising a digital converter 5 of angular velocity coupled to the output shaft, a counter circuit 6 having first and second inputs, a shaping element 7 connected to said first input, said digital converter being connected to said shaping element, an assembly of analog-to-digital converters 8 connected to said second input, sensor means 9 of the operational parameter of the engine and of load connected to said analog-to-digital converters, said counter circuit having four outputs, an electronic actuator 10 connected to the first output of the counter circuit to supply to individual injectors a current pulse with a duration corresponding to the operation time of the electromagnet of the control means of the injectors, a second electronic actuator 11 connected to the second output of the counter circuit which transmits, to individual input valves, pulses controlling the actuators for opening and closing said input valves, a third electronic actuator 12 connected to the third output of the counter circuit 6 which transmits, to individual exhaust valves, pulses controlling the actuators for opening and closing of said exhaust valves, and a fourth electronic actuator connected to the fourth output of the counter circuit 6 which acts upon the power receiver of the engine to vary the load thereof according to an optimum setting of the fuel charge for the given rotational speed of the engine.

2. A diesel engine with electronic control as claimed in claim 1 wherein said counter circuit comprises a digital circuit 15 for calculating rotational speed error with proportional integration, said circuit 15 having first and second inputs, said first input being connected to the first input of said counter circuit 6, control means 17 connected to said first input of the computer counter circuit for emitting pulses in predetermined sequence and duration, an engine parameter processing circuit 42 having three inputs and two outputs, the first input of the processing circuit 42 being connected to the first input of the counter circuit 6, the second input of the processing circuit 42 being connected to the second input of the counter circuit, the third input of the processing circuit 42 being connected to the first output of the digital circuit 15, a digital-to-analog converter 18 having first, second and third inputs and an output, the third input of circuit 42 being connected to the first input of converter 18, the first output of processing circuit 42 being connected to the second input of converter 18, the output of converter 18 being the first output of the counter circuit, three comparators 19, 20, 23 each having three inputs and one output and two programmable timers 21 and 22 each having two inputs and one output, the first output of the engine parameter processing circuit 42 being connected to the second inputs of comparators 19 and 20 and to second inputs of programmable timers 21 and 22, the second output of the engine parameter processing circuit 42 being connected to the second input of circuit 15, the second output of the circuit 15 being connected to the second input of comparator 23, said control means 17 being connected to the third input of circuit 15, the second inputs of the digital integrator circuit 16, the third inputs of comparators 19, 20 and 23 and the third input of the digital-to-analog converter 18, the first output of the digital integrator circuit 16 being connected to the first input of the comparator 19, the second output of the digital integrator circuit 16 being connected to the first input of the comparator 20, a signal of optimum fuel charge being supplied to the first input of the comparator 23, the output of the comparator 19 being connected to the first input of programmable timer 21 the output of which constitutes the second output of the counter circuit 6, the output of the comparator 20 being connected to the first output of the programmable timer 22 the output of which constitutes the third output of the counter circuit 6, the output of the comparator 23 constituting the fourth output of the counter circuit 6.

3. A diesel engine with electronic control as claimed in claim 2 wherein said digital-to-analog converter 18 comprises a binary counter 39 having first and second inputs, the first input of the binary counter constituting the second input of the digital-to-analog converter connected to the digital circuit 15, a decoder 40 connected to the output of the binary counter, a bistable multivibrator 41 having two inputs, the decoder having an output connected to the first input of the bistable multivibrator, the second input of the bistable multivibrator being the first input of the converter 18 connected to the engine processing circuit 42, and an AND circuit 43 having a first input connected to the output of the bistable multivibrator and a second input constituting the third input of the converter 18 connected to the control means 17, the output of the AND circuit 43 being connected to the second input of binary counter 42, the output of the bistable multivibrator constituting the output of the converter 18.

4. A diesel engine with electronic control as claimed in claim 1 wherein said counter circuit comprises a digital circuit 15 for calculating rotational speed error with proportional integration, said digital circuit comprising an AND circuit 24 having one input constituting a first input of the digital circuit 15, a programmable counter having first, second, third, and fourth inputs, the first input constituting a second input of the digital circuit 15, the third input of the programmable counter constituting a third input of the digital circuit 15, a digital setting up unit of parallel structure connected to the second input of the counter 25, the AND circuit having an output connected to the fourth input of the counter 25, an OR circuit having two inputs and an output, a zero-state blocking unit having an input and an output, a second blocking unit for determining optimum fuel charge, said counter having an output connected to the inputs of the zero-state blocking unit, the OR circuit and the second blocking unit, the output of the zero-state blocking unit being connected to the second input of the AND circuit, the output of the second blocking unit being connected to the other input of the OR circuit, proportioning means 30,31 connected to the OR circuit and having an output constituting a first output of the digital circuit 15, a detector 32 connected to the output of the proportioning means, a digital adder 33 having three inputs and an output, a first input of the digital adder being connected to the output of the proportioning means, a second AND circuit 34 having first and second inputs and an output, the first input of the second AND circuit 34 being connected to the output of the detector 32, a digital integrator 35 having two inputs and an output, the first input of integrator 35 being connected to the output of the second AND circuit 34, the second input of integrator 35 being connected to detector 32, the output of integrator 35 being connected to the second input of adder 33, a digital integrator blocking circuit 37 having two inputs and an output and a digital integrator sign circuit 36 having two inputs and an output, the first inputs of the digital integrator sign circuit and digital integrator blocking circuits being connected to the output of the digital integrator, the second inputs of the digital integrator sign circuit and the digital integrator blocking circuit being connected to the output of the detector, the output of digital integrator sign circuit 36 being connected to the second input of the second AND circuit 34, the output of the digital integrator blocking circuit 37 being connected to the third input of adder 33, the output of adder 33 constituting the second output of the digital circuit 15.

5. A diesel engine with electronic control as claimed in claim 1 comprising electronic actuator means for controlling the injectors comprising a main feeder 44 and an auxiliary feeder 45, a magnetic coil 46, a thyristor 47 connecting said main feeder and magnetic coil, a condensor 49 connected in parallel with said thyristor, a diode 50 and resistor 51 connected in series with said thyristor, said auxiliary feeder having lower output than the main feeder and being connected in series therewith such that the negative terminal of the auxiliary feeder is connected to the positive terminal of the main feeder, and a quench condensor 54 connected to the positive terminal of the auxiliary feeder and the positive terminal of the main feeder.

6. A diesel engine with electronic control as claimed in claim 5 comprising a quenching thyristor 48 connected in series with said quench condenser to said magnetic coil.

7. A diesel engine with electronic control as claimed in claim 1 wherein said injectors each comprises a body 55 including an atomizer 56 with a needle 59 therein, and slide valve means controlling the injection, said electromagnet having an armature mechanically coupled to said slide valve means.

8. A diesel engine with electronic control as claimed in claim 7 wherein each said injector further comprises a piston 61 slidably mounted in a cylindrical chamber 62 provided in said body, said piston having a lower end facing said needle, and in contact therewith, said needle 59 having an end remote from the end in contact with the piston which is tapered, said piston and needle forming a differential assembly in which the largest diameter of the piston is greater than the largest diameter of the needle.

9. A diesel engine with electronic control as claimed in claim 8 wherein said slide valve means comprises a spool member 63 having enlarged portions 64 spaced thereon to form at least two peripheral channels 65, 66, a support with a cylindrical bore 67 slidably receiving said spool member 63, said support having at least one peripheral channel 68 disposed with respect to said enlarged portions such that in the lowest position of the spool member, at least one of said peripheral channels (65) together with at least one of said peripheral channels (68) hydraulically connect chamber 62 with a fluid pressure medium supply source 69,70 whereas in the upper position of the spool member one of the peripheral channels (66) together with the peripheral channel (68) connect chamber 62 with a discharge conduit 11.

10. A diesel engine with electronic control as claimed in claim 9 wherein said support is provided with a discharge conduit 72, and overflow valve means 73 and at least one gland 74 and 75 between said discharge conduits (71 and 72).

* * * * *